US009033170B2

(12) United States Patent
Mansoorian

(10) Patent No.: US 9,033,170 B2
(45) Date of Patent: May 19, 2015

(54) BLOSSOM STEMWARE WITH TOOTHPICK DISPOSER

(71) Applicant: Arax Roxy Mansoorian, Glendale, CA (US)

(72) Inventor: Arax Roxy Mansoorian, Glendale, CA (US)

( * ) Notice: Subject to any disclaimer, the term of this patent is extended or adjusted under 35 U.S.C. 154(b) by 0 days.

(21) Appl. No.: 14/047,867

(22) Filed: Oct. 7, 2013

(65) Prior Publication Data

US 2014/0097105 A1 Apr. 10, 2014

Related U.S. Application Data

(60) Provisional application No. 61/744,895, filed on Oct. 5, 2012, provisional application No. 61/797,520, filed on Dec. 10, 2012.

(51) Int. Cl.
*A47G 19/22* (2006.01)
*A47G 19/30* (2006.01)

(52) U.S. Cl.
CPC ..... *A47G 19/2205* (2013.01); *A47G 19/30* (2013.01)

(58) Field of Classification Search
CPC ..... A47G 19/2227; A47G 19/2255; A47G 19/2283; A47G 19/2222; A47G 19/2205; A47G 19/30; A47G 19/22
USPC ..... 215/374, 373, 372, 371, 375, 390; 220/630, 628; 206/217, 216; D7/513, D7/537, 532, 524
See application file for complete search history.

(56) References Cited

U.S. PATENT DOCUMENTS

| | | | | | |
|---|---|---|---|---|---|
| 2,135,242 | A * | 11/1938 | Smith | 206/216 |
| 2,781,651 | A * | 2/1957 | Cutler | 248/346.11 |
| 5,375,828 | A * | 12/1994 | Shikami | 273/110 |
| 2013/0228544 | A1 * | 9/2013 | Benetti | 215/378 |

* cited by examiner

*Primary Examiner* — Robert J Hicks
(74) *Attorney, Agent, or Firm* — John Alumit

(57) ABSTRACT

Decorative stemware having a plurality of apertures about the circumference of the stem for the insertion of toothpicks having cocktails or hors d'oeuvres, the apertures being diagonally disposed within the stem so that when toothpicks with cocktails or hors d'oeuvres are inserted into the apertures, the stemware creates the appearance of blossoming stemware. The stemware features a base that functions as a toothpick disposer. Alternatively, a separate coaster can function as a toothpick disposer. The base, or coaster, comprises an opening for the insertion of toothpicks and a hollow interior for the insertion of a plurality of toothpicks. A themed design is disposed on the base or coaster to conceal or camouflage the disposed toothpicks.

19 Claims, 5 Drawing Sheets

BLOSSOM STEMWARE WITH TOOTHPICK DISPOSER

CROSS-REFERENCE TO RELATED APPLICATION

This application claims the benefit of provisional patent application Nos. 61/744,895 filed on Oct. 5, 2012 and 61/797,520 filed on Dec. 10, 2012.

FEDERALLY SPONSORED RESEARCH

Not Applicable

SEQUENCE LISTING OR PROGRAM

Not Applicable

BACKGROUND

The present invention relates to stemware, in particular, stemware capable of holding hors d'oeuvres on toothpicks and disposing of said toothpicks, while at the same time serving to decorate the stemware.

At many cocktail parties and social receptions, both cocktails and alcohol are served to guests. Cocktail parties commonly involve the use of glassware for champagne, wine, margaritas, martinis, beer, or other alcohol, or hors d'oeuvres with toothpicks. A common problem arises for guests wanting to drink their champagne on the one hand, and eat a hors d'oeuvre on the other. Guests must balance the champagne on the one hand and hold a hors d'oeuvre on the other, often holding a separate plate. During conversations with other guests, this can be inconvenient and burdensome. To free at least one hand, guests often abandon one or the other, so that plates of hors d'oeuvres, toothpicks, toothpicks, and unfinished champagne are strewn about a reception.

At the same time, these social events provide a décor suitable for a given event (e.g., business meeting, wedding, sporting event, etc.). Decorations are an important part of a cocktail reception. Any means for addressing the burden of having to balance champagne and hors d'oeuvres, and do away with abandoned toothpicks and champagne glasses, must also take into consideration the décor of the social event.

The present invention addresses both of these challenges by providing stemware with apertures for holding hors d'oeuvres served on toothpicks, said stemware also containing a base having features to dispose of said toothpicks while at the same time comprising a design or theme to conceal the disposed toothpicks. In an alternate embodiment, a coaster serves the function of a toothpick disposer.

SUMMARY

The present invention consists of decorative stemware, wherein the stem comprises at least one aperture having a circumference wide enough and long enough to permit the insertion of a toothpick holding an hors d'oeuvre, and a base preferably detachable from the stem, comprising an opening for the insertion of toothpicks and also preferably featuring a themed design to conceal or camouflage the toothpicks. In this way, the stem holds toothpicks with hors d'oeuvres, while the base functions as a toothpick disposer. In an alternate embodiment, a separate coaster serves the function of a toothpick disposer while the base of the stemware is unchanged.

DRAWINGS

Figure 1:
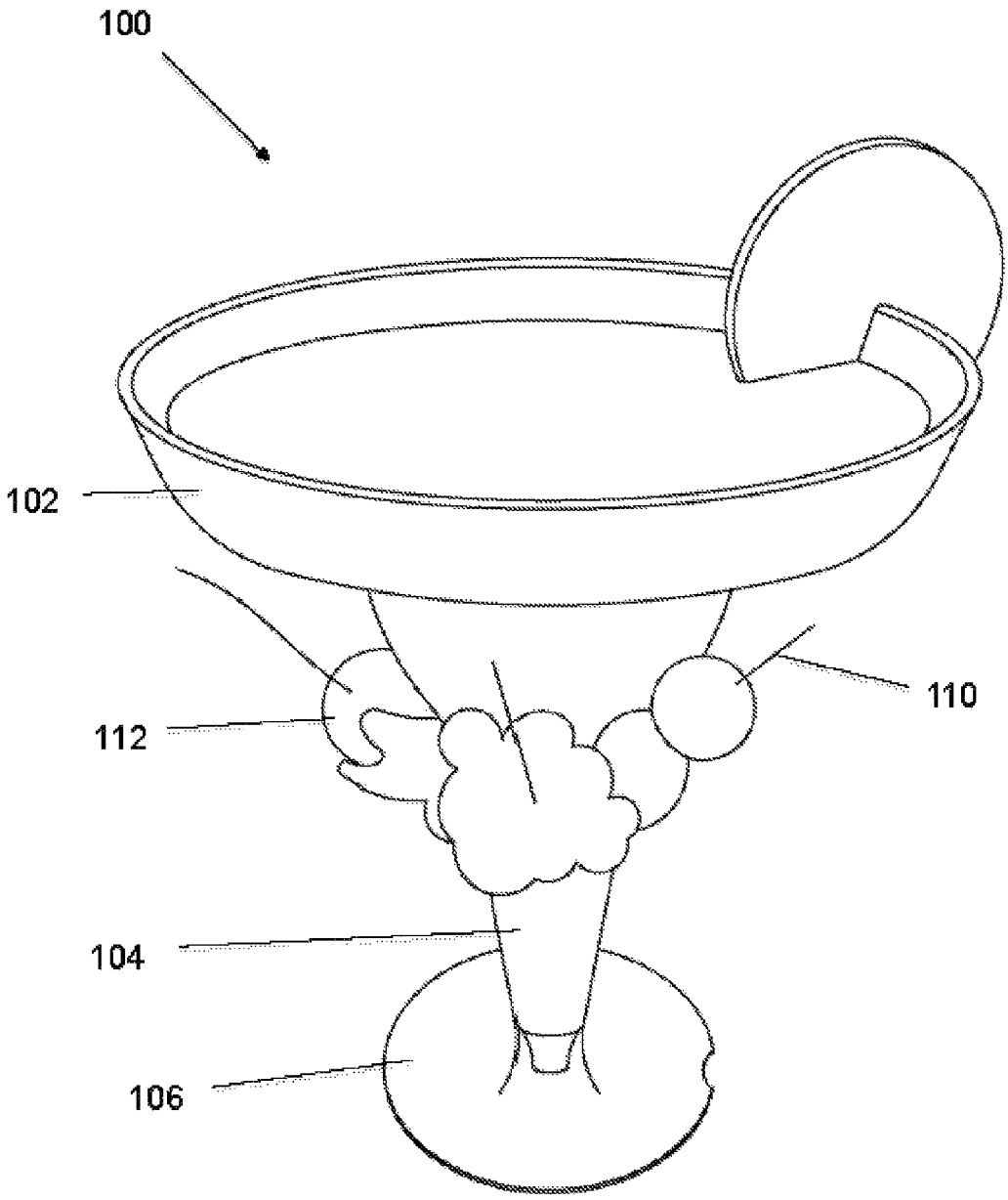

FIG. 1 A perspective view of the preferred embodiment of the invention shows cocktails inserted into a cup using toothpicks to create decorative stemware, and the base of the stemware serving as a toothpick disposer.

Figure 2:
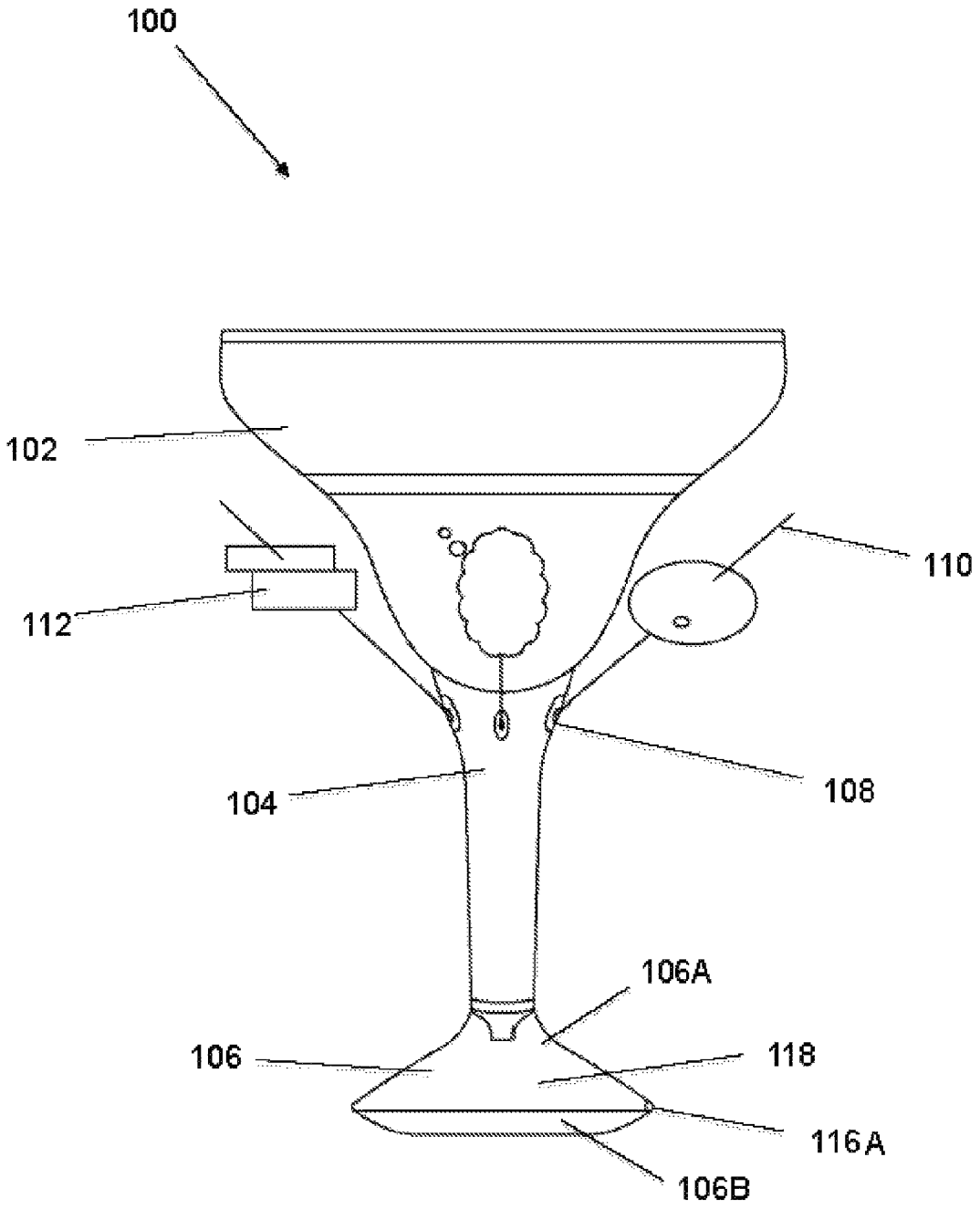

FIG. 2 A side view of the invention on different stemware.

Figure 3:
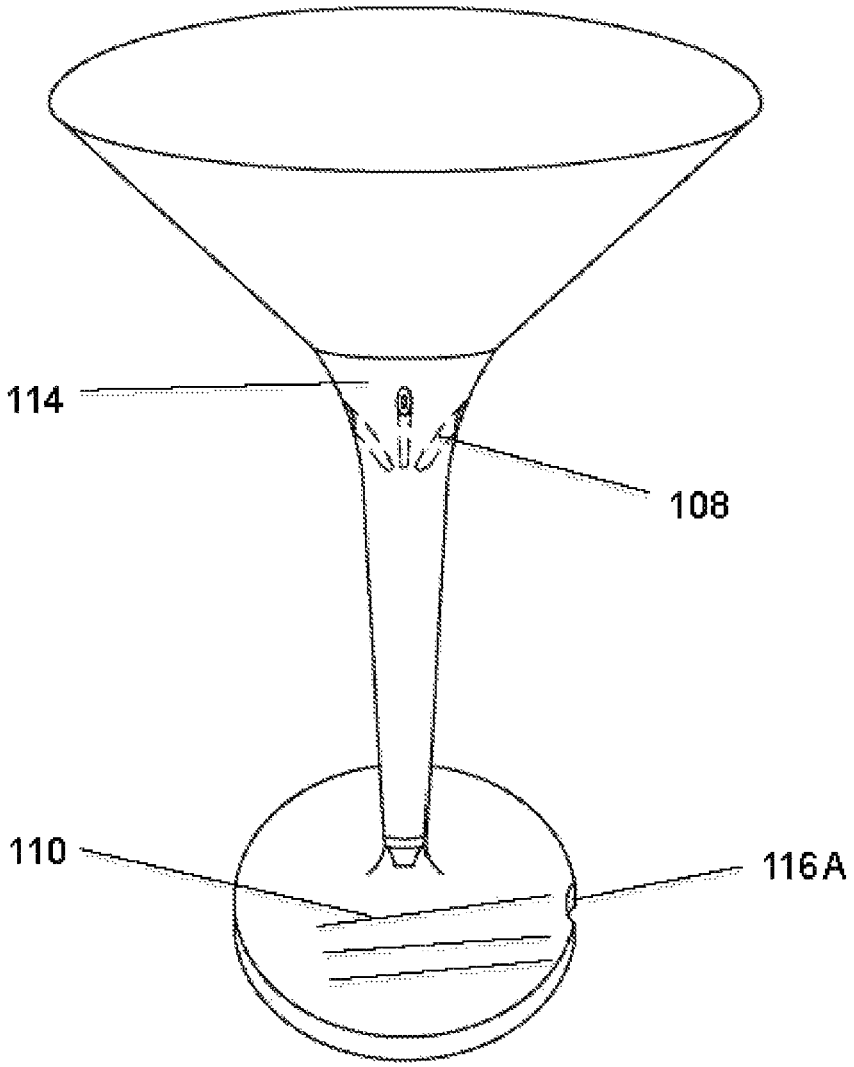

FIG. 3 A perspective view of the invention on different stemware, without the cocktails, showing the apertures into which toothpicks are inserted and the toothpick disposer at the base.

Figure 4:
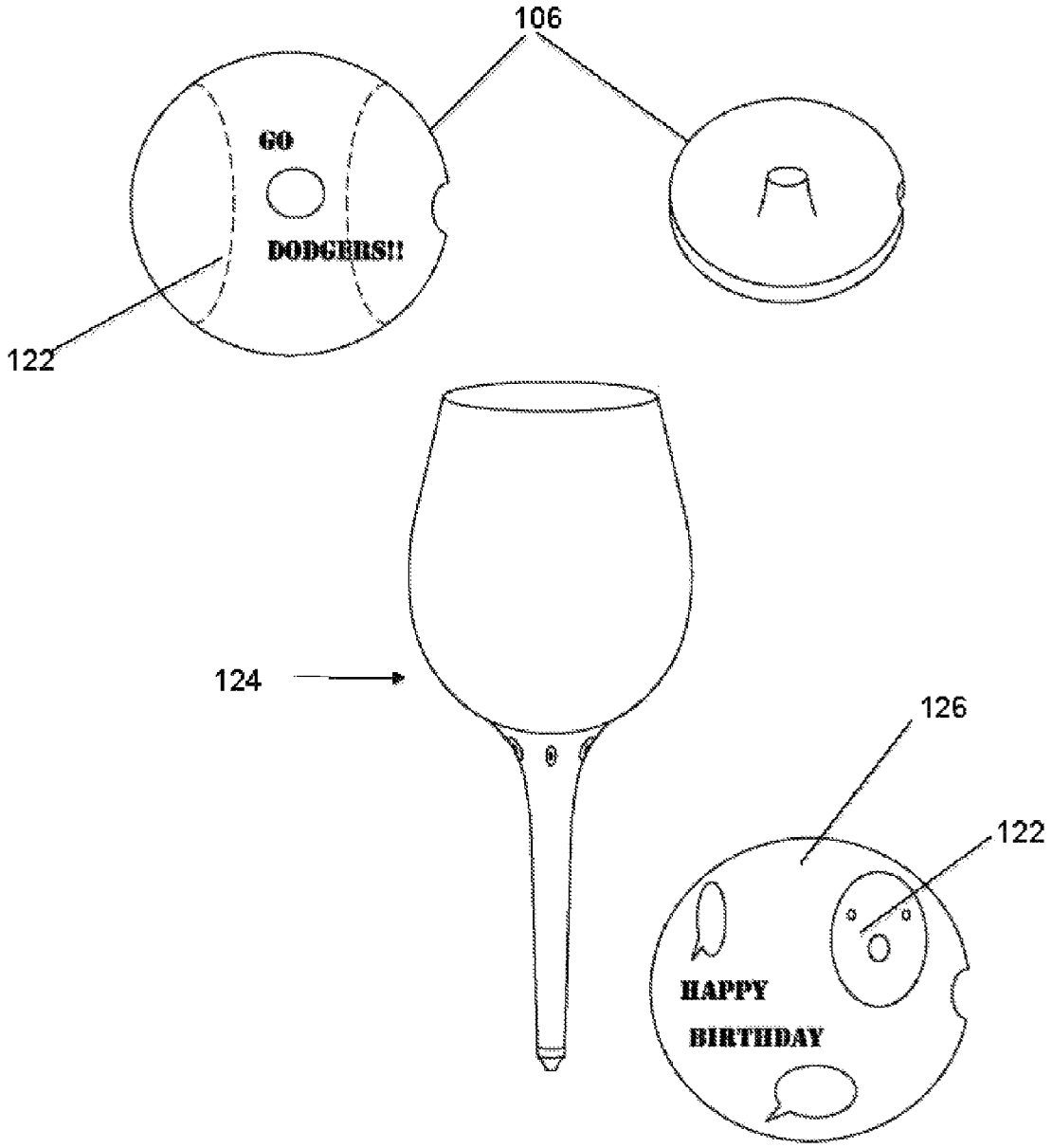

FIG. 4 A side view of the invention showing the toothpick disposer in the form of a coaster.

Figure 5:
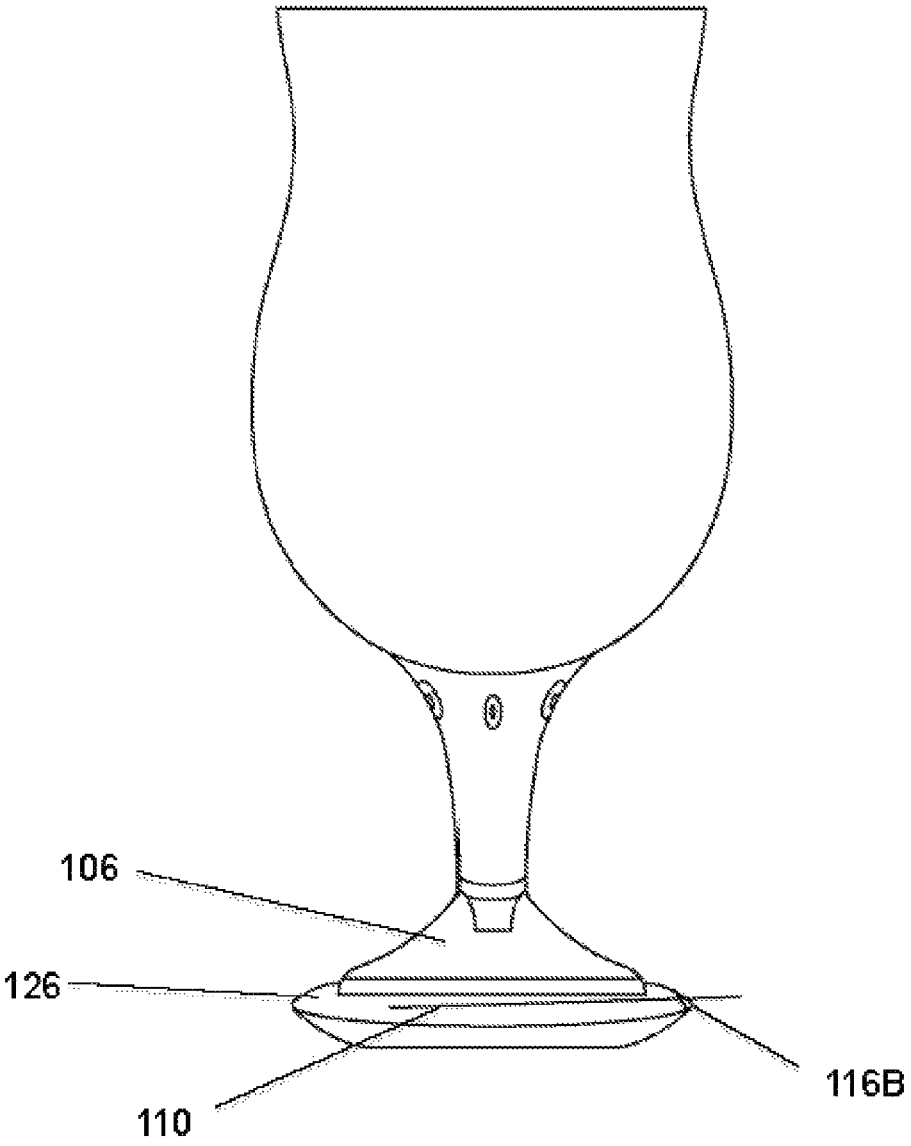

FIG. 5 Shows various designs on the toothpick disposers to conceal disposed toothpicks. FIG. 5 also illustrates the interchangeability of the bases.

REFERENCE

100 decorative stemware
102 bowl
104 stem
106 base
106A top base portion
106B bottom base portion
108 aperture
110 toothpick
112 hors d'oeuvre/cocktail
114 upper portion of the stem
116A small opening of the base
1168 small opening of the coaster
118 hollow area of the base
120A bottom surface of the base
1208 top surface of the base
122 design
124 stems with bowls
126 coaster

DESCRIPTION

FIG. 1 shows an exemplary embodiment of the decorative stemware 100. Toothpicks 110 holding hors d'oeuvres/cocktails 112 are inserted into the stem 104, supported by a base 106. As shown in FIG. 2, the stem 104 comprises at least one aperture 108 wide enough and long enough to accommodate a toothpick 110 holding an hors d'oeuvre 112. In a preferred embodiment, the stem 104 comprises a plurality of apertures 108 to accommodate a plurality of toothpicks 110 holding hors d'oeuvres 112. As shown in FIG. 3, the apertures 108 are preferably disposed diagonally inside the upper portion 114 of the stem 104 where the stem 104 is thickest so that when a toothpick 110 is inserted, the toothpick 110 juts upwardly and outwardly to create the appearance of blossoming stemware as best seen in FIGS. 1 and 2. While the preferable embodiment is to have a row of apertures 108 around the circumference of the upper portion of the stem, it is conceivable that apertures 108 can appear anywhere on the stem 104 provided that the stem 104 is thick enough for an aperture 108 into which a toothpick 110 may be inserted.

Stemware, in particular, disposable, plastic stemware, often has a detachable base 106 as best seen in FIG. 4. The present invention also comprises a detachable base, however, as best seen in FIGS. 2 and 3, the base 106 is thicker and hollow to allow for the insertion of used toothpicks through a small opening 116 of the base. The hollow area 118 of the base is sufficiently wide to accommodate at least one toothpick 110. To conceal or camouflage the used toothpick(s), the bottom 120A or top 120B surface of the base, as referenced in FIG. 2, should comprise a design 122 as shown in FIG. 4, preferably a themed design suitable for a social event (e.g., a Happy Birthday wish, a sports team's name, a Holiday design, a congratulatory message, a wedding design, etc.). Without a design, the base 106 would be transparent and disposed toothpicks would be visible and unattractive.

Still referring to FIG. 4, because the base 106 is detachable from the stem 104, the base 106 can be interchanged with various themed bases 106 suitable for a given occasion. In this scenario, a user can keep one set of stems with bowls 124, and order a variety of bases 106 with various themes. The detachable base also makes for easy packaging.

Referring back to FIG. 2, the base 106 can comprise one unit with an opening, or can comprise two separate units, a top base portion 106A and a bottom base portion 106B, pressed or screwed together. In this way, a user can insert new themed designs (with or without a message) in lieu of ordering premade bases with fixed designs (with or with a message). Also, a user can remove the bottom base portion to remove the disposed toothpicks, and reuse the base.

It should be noted that while the apertures in the stem are designed for the insertion of toothpicks, any other object can be inserted such as a piece of jewelry or a flower. It should further be noted while the base functions to house disposed toothpicks, the can be used to house other objects such as sand and seashells (for tropical themes), whatever is appropriate for the occasion.

In the present invention, the base 106 functions as a toothpick disposer. However, in an alternate embodiment, as shown in FIG. 5, a separate coaster 126 can serve the function of a toothpick disposer, preferably having the same features of the above-described base. In this way, stemware with or without apertures for insertion of toothpicks, would at least have a toothpick disposer in the form of a coaster 126, if the base does not already function as a toothpick disposer.

Any element in a claim that does not explicitly state "means for" performing a specified function, or "step for" performing a specific function, is not to be interpreted as a "means" or "step" clause as specified in 35 U.S.C. §112, paragraph 6. In particular, the use of "step of" in the claims herein is not intended to invoke the provisions of 35 U.S.C. §112, paragraph 6.

Although preferred embodiments of the present invention have been shown and described, various modifications and substitutions may be made thereto without departing from the spirit and scope of the invention. Accordingly, it is to be understood that the present invention has been described by way of illustration and not limitation.

The following are claimed:

1. Stemware comprising a bowl, a stem, and a base, wherein the stem comprises at least one aperture wide enough and long enough to support a toothpick holding an hors d'oeuvre, wherein the base comprises an opening wide enough for insertion of a toothpick, and wherein said base comprises a hollow interior, large enough to accommodate at least one toothpick.

2. The stemware of claim 1, wherein the at least one aperture is disposed on an upper portion of the stem below the bowl where the stem is thickest.

3. The stemware of claim 1, wherein the at least one aperture is diagonally disposed within the stem.

4. The stemware of claim 1, wherein a plurality of apertures are disposed around the circumference of the stem.

5. The stemware of claim 1, wherein the base comprises a design, with or without a message, to conceal or camouflage the presence of used toothpicks in the base.

6. The stemware of claim 5, wherein the design is a themed design disposed on a top or bottom surface of the base.

7. The stemware of claim 1, wherein the base comprises two pieces, a top portion and a bottom portion, detachably attached, capable of being pressed or screwed together, while maintaining a hollow interior when attached.

8. The stemware of claim 1, wherein the base is detachable from the stem for easy packaging.

9. Stemware comprising a bowl, a stem, a base, and a coaster, wherein the stem comprises at least one aperture wide enough and long enough to support a toothpick holding an hors d'oeuvre, wherein the coaster comprises an opening wide enough for the insertion of a toothpick, and wherein said coaster comprises a hollow interior, large enough to accommodate at least one toothpick.

10. The stemware of claim 9, wherein the at least one aperture is disposed on an upper portion of the stem below the bowl where the stem is thickest.

11. The stemware of claim 9, wherein the at least one aperture is diagonally disposed within the stem.

12. The stemware of claim 9, wherein a plurality of apertures are disposed around the circumference of the stem.

13. The stemware of claim 9, wherein the coaster comprises a design, with or without a message, to conceal or camouflage the presence of used toothpicks in the base.

14. The stemware of claim 13, wherein the design is a themed design disposed on a top or bottom surface of the coaster.

15. The stemware of claim 9, wherein the coaster comprises two pieces, a top portion and a bottom portion, detachably attached, capable of being pressed or screwed together, while maintaining a hollow interior when attached.

16. A coaster comprising a top base portion and a bottom base portion, as one unit, wherein an opening is formed where the top base portion and bottom base portion meet, said opening is wide enough for the insertion of a toothpick, and wherein said coaster comprises a hollow interior, large enough to accommodate at least one toothpick.

17. The coaster of claim 16, wherein the coaster comprises a design, with or without a message, to conceal or camouflage the presence of used toothpicks in the coaster.

18. The coaster of claim 17, wherein the design is a themed design disposed on a top or bottom surface of the coaster.

19. A coaster comprising two pieces, a top base portion and a bottom base portion, detachably attached, capable of being pressed or screwed together, wherein an opening is formed where the top base portion and bottom base portion meet, said opening is wide enough for the insertion of a toothpick, and wherein said coaster comprises a hollow interior, large enough to accommodate at least one toothpick.

* * * * *